United States Patent [19]

Harmsen et al.

[11] 3,932,935

[45] Jan. 20, 1976

[54] METHOD FOR MANUFACTURING A DUCTILE SILVER METALLIC OXIDE SEMI-PRODUCT

[75] Inventors: Ulf O. Harmsen, Pforzheim; Wolfgang S. Pottken, Keltern, both of Germany

[73] Assignee: Dr. Eugene Durrwachter DODUCO, Pforzheim, Germany

[22] Filed: Feb. 14, 1974

[21] Appl. No.: 442,683

[30] Foreign Application Priority Data

Mar. 3, 1973 Germany ..... 2310784

[52] U.S. Cl. ..... 29/630 C; 29/497.5; 72/258; 72/363

[51] Int. Cl.[2] ..... H01R 9/00

[58] Field of Search ..... 72/258, 362, 363; 29/472.3, 497.5, 498, 630 C, 504; 200/262, 265, 266

[56] References Cited

UNITED STATES PATENTS

| | | | |
|---|---|---|---|
| 3,114,631 | 12/1963 | Sistare et al. | 200/266 |
| 3,144,576 | 8/1964 | Hagmaier et al. | 72/258 |
| 3,258,829 | 7/1966 | Gwyn | 200/266 |
| 3,545,067 | 12/1970 | Haabye et al. | 29/630 C |
| 3,802,062 | 4/1974 | Harmsen et al. | 29/630 C |
| 3,814,640 | 6/1974 | Shibata | 29/630 C |
| 3,821,848 | 7/1974 | Backstrom | 29/630 C |

*Primary Examiner*—C. W. Lanham
*Assistant Examiner*—James R. Duzan

[57] ABSTRACT

There is produced a ductile silver-metallic oxide semi-finished product, for example a silver cadmium oxide wire, or a sheet or square rod having silver-metallic oxide, silver-metallic, and silver metalloid compounds. There are assembled in sandwich fashion several plates of internally oxidized silver-metallic oxide and of powder metallurgically produced silver-metallic oxide. The sandwich is then extrusion pressed.

9 Claims, 2 Drawing Figures

METHOD FOR MANUFACTURING A DUCTILE SILVER METALLIC OXIDE SEMI-PRODUCT

THE INVENTION

Figure 1:
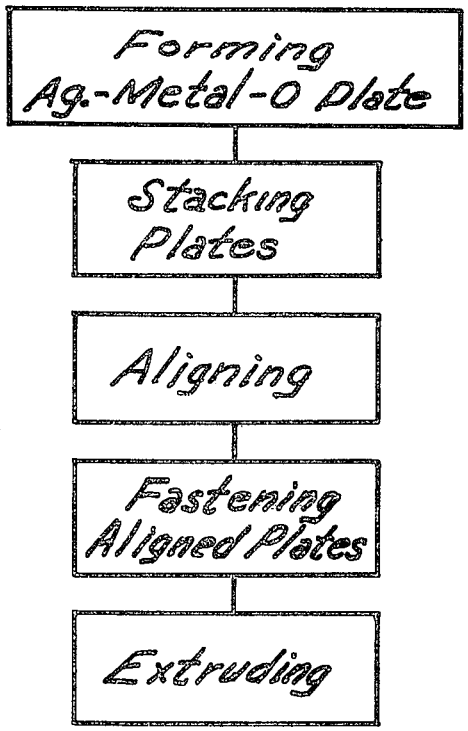

The present invention relates to a method of manufacturing a ductile silver metallic oxide semifinished product for producing contacts.

Silver metallic oxide materials with oxide contents of 2 to 20 percent by weight, in particular silver cadmium oxide, silver tin oxide and silver zinc oxide are known to have a very low tendency to fuse and are used to a large extent as electrical contacts for switching mechanisms with high switching rates at low or medium loads (H. Schreiner, Pulvermetallurgie elektrischer Kontakte, Springer-Verlag, Berlin, Gottingen, Heidelberg, 1964, p. 163 ff.).

It is generally recognized that the best known contact material of the silver metallic oxide group is silver cadmium oxide. Since silver cadmium oxide is a relatively brittle substance, to facilitate the additional treatment of existing material as silver cadmium oxide to make electrical contacts, the ductility of the material is important (A. Keil, Zeitschrift fur Metallkunde 57 (1966) issue No. 2, pp. 151–155).

Silver metallic oxide substances can be produced according to the process of internal oxidation - if the oxides do not produce surface layers - and in accordance with the powder metallurgical process (H. Schreiner, Pulvermetallurgie electrischer Kontakte, Springer-Verlag, Berlin, Gottingen, Heidelberg, 1964, pp. 164–185).

Upon the internal oxidation of wire or bar material, fissures and hollows arise in the peripheral zone crystal boundary. These fissures and hollows are caused by internal stresses which arise from the increase in volume during oxidation (A. Keil, lecture Bemerkungen zur inneren Oxidation von Silber-Cadmium-Legierungen, Kontakttagung Orono, Proceed III Intern.Res.-Symp. on Electrical Contact Phenomena, June, 1966). In spite of the use of additions to refine the crystal structure so as to increase the ductility e.g. with silver cadmium materials (German Pat. No. 1 153 178), it has been frequently observed that material pre-oxidized in wire form becomes unusable during deformation to make the contact assembly using a rivet (or pin) because of fissures at the head of the rivet. Wire with high oxide contents of, say, 15 percent by weight cadmium oxide and copper oxide cannot be produced free of fissures by using the internal oxidation method since wide cracks arise in the wire due to the change in volume during the oxidation process.

Silver tin oxide and silver zinc oxide materials with oxide contents from 5 percent by weight upwards cannot be produced by internal oxidation since surface layers interfer with the oxidation mechanism and a uniform oxidation front cannot be achieved. These materials can be produced only by using powder metallurgy. Powder metallurgical manufacture of wire or bar materail lessens fissure formation through change in volume, but even such a powder metallurgical material having a high oxide content of about 15 percent by weight is brittle and not easily deformable.

It is an object of the present invention to produce a wire or bar made from silver metallic oxide with high oxide contents of 5 to 20 percent by weight which is ductile, has no fissures in the material and is suitable for rivet hammering.

According to the present invention a method of producing a ductile silver metallic oxide semifinished product, especially for the preparation of electrical contacts, comprises the steps of assembling several of any internally oxidized silver-metallic oxide plates and powder metallurgically produced silver-metallic oxide plates to form a bar, and pressing the bar. It has been found that a wood-like fibrous structure of the metallic oxide stratum has a favourable effect on subsequent handling of the semifinished product to form a rivet and the connection between the individual sheets is perfect. In this way, for example, silver cadmium oxide wires, sheets and square rods with silver-metallic, silver-metallic oxide and silvermetalloid ingredients can be produced.

Figure 2:
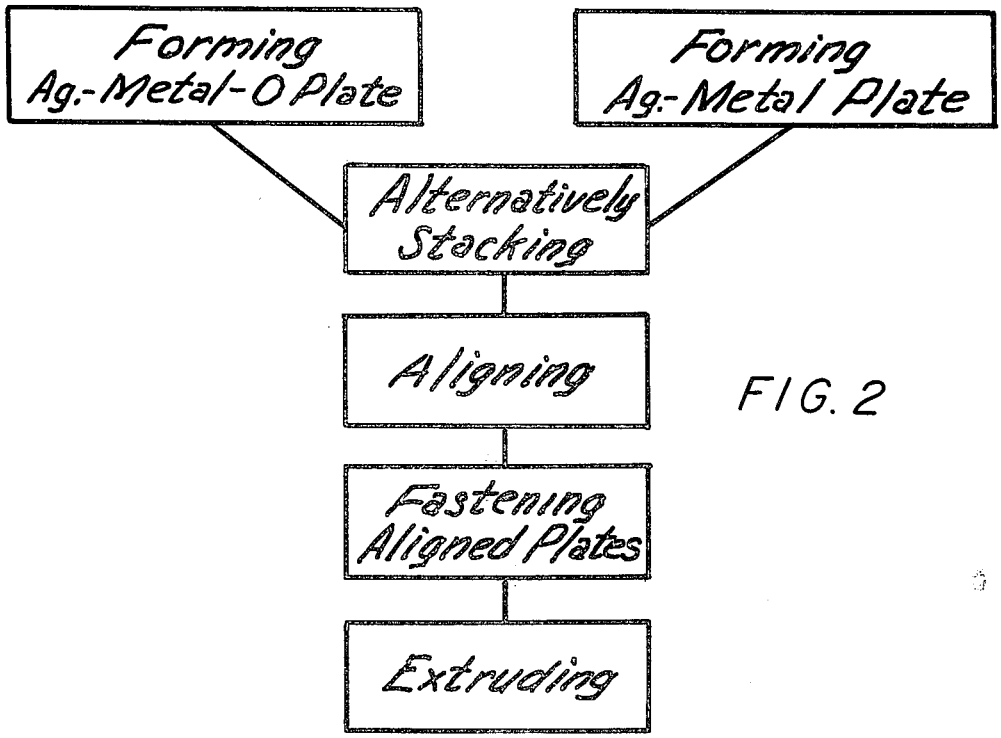

FIGS. 1 and 2 illustrate by means of flow charts, the processes of the subject invention.

FIG. 1 illustrates the process of this invention as applied to a starting material of silver metallic oxide plate. First, the plate is formed, and then, as illustrated in the flow chart, the plates are stacked and aligned. The aligned plates are fastened, e.g., by welding, and then the stack of plates is extruded.

FIG. 2 relates to a second embodiment of the subject invention, where the starting material is a combination of silver metal and silver metallic oxide plates. As illustrated in the FIGURE, first the silver metal and the silver metallic oxide plates are formed. They are then collated in alternating sheets or plates, and the plates are subsequently fastened, e.g., by welding, to maintain the alignment for the extruding stuff.

EXAMPLE 1

20 plates of AgCd, having dimensions of 4 × 80 × 350 mm and having a nickel additive of about 0.2 percent by weight to refine the crystals, were internally oxidized for 2 days at 820°C at an oxygen pressure of 3 atm., then laid one on top of the other to form a package measuring 80 × 80 × 350mm that was flattened under a press. At the corners the plates were secured by riveting or welding to maintain the package. This square bar was pressed at 500°C in a 500 ton extrusion press to form a wire of 7mm diameter. The wire, by repeated intermediate annealing, was perfectly drawn to 2.85mm diameter and hammered into rivets measuring 7mm head diameter, 1.5mm head height, 3mm tail length and 3mm tail diameter.

EXAMPLE 2

80 plates of AgCd measuring 1 × 80 × 350mm were oxidized at 820°C at an oxygen pressure of 3 atmospheres for 14 hours and subsequently processed as described in Example 1.

EXAMPLE 3

40 plates of AgCd measuring 1 × 80 × 350mm were internally oxidized for 14 hours in air at 820°C and alternately laid one on top of the other with plates of an Ag/graphite alloy having a composition of approximately 99 wt.% Ag to 1 wt.% graphite, or an AgNi alloy having a composition of approximately 90 wt.% Ag to 10 wt.% Ni, or an AgCuO alloy having a composition of approximately 92 wt.% Ag to 8 wt.% CuO, 8 to form a package 80 × 80 × 350mm, and then processed as in Example 1.

EXAMPLE 4

20 plates, measuring 4 × 80 × 350mm, of a powder metallurgically produced AgCdO alloy having a composition of approximately 90 wt.% Ag to 10 wt.% CdO were laid one on top of the other to form a package 80 × 80 × 350mm and extrusion pressed to form a wire 7mm diameter and then processed as in Example 1 to make rivets.

EXAMPLE 5

40 plates, measuring 2 × 80 × 350mm, of a powder metallurgically produced alloy of AgZnO having a composition of approximately 90 wt.% Ag to 10 wt.% ZnO, or $AgZnO_2$ having a composition of approximately 90 wt.% Ag to 10 wt.% $ZnO_2$, or $AgFe_2O_3$ having a composition of approximately 90 wt.% Ag to 10 wt.% $Fe_2O_3$, or $AgIn_2O_3$, or AgCuO having a composition of approximately 90 wt.% Ag to 10 wt.% CuO, or $AgMoO_3$ having a composition of approximately 95 wt.% Ag to 5 wt.% $AgMoO_3$, were laid one on top of the other to form a package measuring 80 × 80 × 350mm and extrusion pressed to form a wire of 7mm diameter and processed as in Example 1 to form rivets.

EXAMPLE 6

40 powder metallurgically produced plates, including alloys of AgCdO having a composition of approximately 85 wt.% Ag to 15 wt.% CdO, or AgZnO having a composition of approximately 85 wt.% Ag to 15 wt.% ZnO, or $AgSnO_2$ having a composition of approximately 90 wt.% Ag to 10 wt.% $SnO_2$, or $AgFe_2O_3$ having a composition of approximately 90 wt.% Ag to 10 wt.% $Fe_2O_3$, were applied one on top of the other alternately with plates of an Ag/graphite alloy having a composition of approximately 99 wt.% Ag to 1 wt.% graphite, or an AgNi alloy having a composition of approximately 90 wt.% Ag to 10 wt.% Ni, or an AgCuO alloy having a composition of approximately 92 wt.% Ag to 8 wt.% CuO all measuring 1 × 80 × 350mm to form a square pressed bar 80 × 80 × 350mm and then processed as in Example 1.

What is claimed is:

1. A method for producing a ductile silver metallic oxide semi-finished product comprising:

a. selecting plates of a particular silver-metallic oxide material from a class consisting of internally oxidized and powder metallurgically produced material;

b. stacking said plates;

c. aligning said plates in a predetermined relationship for subsequent extrusion;

d. securing said alignment; and e. extruding said plates under conditions of elevated temperature and pressure.

2. The process of claim 1 in which said plates are stacked alternatively with plates selected from the group consisting of silver-metallic and silver metalloid material.

3. A method as claimed in claim 1, wherein the oxide plates have a metallic oxide content of from 5 to 20 percent by weight, and the oxides are selected from the group consisting of cadmium oxide, zinc oxide, tin oxide, copper oxide, lead oxide, iron oxide, indium oxide, molybdenum oxide, manganese oxide, antimony oxide, nickel oxide, and mixtures of these oxides.

4. A method as claimed in claim 3, wherein the oxide plates have a metallic oxide contact of approximately 15 percent by weight.

5. A method as claimed in claim 3, wherein the metallic oxide is cadmium oxide.

6. A method as claimed in claim 1, wherein the bar has a wood-like, fibrous oxide strata structure.

7. A method as claimed in claim 1, wherein the pressed bar is of square cross-section.

8. A method as claimed in claim 1, wherein the bar is composed of several plates 0.1 to 20mm thick.

9. A method as claimed in claim 8, wherein the plates are each approximately 1mm thick.

* * * * *